US006963719B2

(12) United States Patent
Jaskowiak

(10) Patent No.: US 6,963,719 B2
(45) Date of Patent: Nov. 8, 2005

(54) THIN WALLED FUSER ROLL WITH STRENGTHENED KEYWAY

(75) Inventor: Timothy R. Jaskowiak, Webster, NY (US)

(73) Assignee: Xerox Corporation, Stamford, CT (US)

( * ) Notice: Subject to any disclaimer, the term of this patent is extended or adjusted under 35 U.S.C. 154(b) by 135 days.

(21) Appl. No.: 10/736,961

(22) Filed: Dec. 16, 2003

(65) Prior Publication Data

US 2005/0129435 A1 Jun. 16, 2005

(51) Int. Cl.[7] ..... G03G 15/20
(52) U.S. Cl. ..... 399/333; 399/330
(58) Field of Search ..... 399/320, 328, 399/330, 333, 335; 430/99, 124

(56) References Cited

U.S. PATENT DOCUMENTS

| | | | | |
|---|---|---|---|---|
| 5,687,297 | A | 11/1997 | Coonan et al. | 395/102 |
| 6,069,624 | A | 5/2000 | Dash et al. | 345/333 |
| 6,393,248 | B1 * | 5/2002 | Tsurusaki et al. | 399/330 |

* cited by examiner

*Primary Examiner*—Hoang Ngo
(74) *Attorney, Agent, or Firm*—Richard F Spooner

(57) ABSTRACT

A thin-walled fuser roll core cylinder assembly permitting fast warm-up times and improved energy efficiency wherein cracking of the thin walls due to cyclic compression is prevented by strengthening the thin walls proximate to the end region where the core cylinder is engaged by the drive gear. Use of such a thin-walled fuser roll in an imaging system and a process of fusing toner onto a copy substrate using the thin-walled fuser core.

26 Claims, 5 Drawing Sheets

THIN WALLED FUSER ROLL WITH STRENGTHENED KEYWAY

CROSS-REFERENCE TO RELATED APPLICATIONS

Reference is made to commonly-assigned copending U.S. patent application Ser. No. 10/737,456, filed herewith, entitled "THIN WALLED FUSER ROLL WITH STRESS REDIRECTED FROM AXIAL TO RADIAL DIRECTION", by Timothy R. Jaskowiak, et al., the disclosure of which is incorporated herein.

BACKGROUND AND SUMMARY

Fuser rolls used in electrostatographic imaging systems generally comprise a metal core cylinder coated with one or more elastomer layers. Conventional fuser roll core cylinders are relatively thick walled aluminum alloy cylinders. Such thickness has been desired in order to provide strength and durability as the fuser roll presses against the nip of the adjoining compression roll. For a 35.00 mm outside diameter fuser roll core, a thickness of 5.5 mm is fairly standard. Similar dimensions are common in office and production printing systems capable of imaging more than 50 pages per minute. One drawback to such relative thickness is that thicker walls make the cylinder more massive. Since a typical fuser must attain a fusing temperature of approximately 150° C., significant power and time are required to heat and maintain the fuser at fusing temperatures. For conventional fuser cores of about 5.5 mm thickness, warm-up time lasts from about 7 to about 30 minutes.

In order to save energy and to shorten warm-up times, it would be desirable to reduce the wall thickness of fuser cylinder cores as much as possible. Experience indicates, however, that simply thinning cylinder walls creates problems in the end region of the cylinder. In particular, weakness and cracking results at the end if conventional drive slots are machined into the fuser core cylinders. Drive slots are used as part of the system to rotate fuser cylinder cores. As shown in FIG. 1, rotation is generally caused by mating a core cylinder 10 snugly with a drive gear 11. Mating occurs by driving key 15 into slot 14. Because heating lamps need to be inserted into the fuser roll core subsequent to mating of drive gear 11 to cylinder 10, the inside diameter of drive gear 11 forms a sleeve 12 that slips over core cylinder 10 in the manner shown. Key pin 15 protrudes inwardly from sleeve 12 to engage slot 12. Another reason that sleeve 12 slips over cylinder 10 rather than into cylinder 10 is that drive gear 11, together with sleeve 12, is generally made of rigid plastic. Such plastic has a different co-efficient of expansion than the metal of cylinder 10. Thus, if sleeve 12 protruded inside of cylinder 10, the metal of cylinder 10 would expand at a rate greater than the plastic of drive gear 11 during fusing and thereby create undesirable looseness between drive gear 11 and cylinder 10.

It would be desirable to produce a durable thin-walled core fuser cylinder that enables energy efficiency and fast warm-up times while meeting or exceeding specifications for durability and imaging performance.

One embodiment of a thin-walled fuser roll assembly of the present invention is a thin-walled fuser roll assembly, comprising: a metallic core cylinder having a wall thickness between about 0.5 millimeters and about 2.0 millimeters, an end region, and having an axial and a radial direction; a drive gear having an internal diameter sleeve for fitting over an end of the core cylinder and a key for forcing rotation of the core cylinder; a keyway in the end region of the core cylinder for receiving the drive gear key; and a means for providing strength to the core cylinder wall proximate to the keyway sufficient to prevent cracking from repeated cyclic compression.

Another embodiment of the present invention is an electrostatographic imaging system, comprising: a thin-walled fuser roll assembly, comprising: a metallic core cylinder having a wall thickness between about 0.5 millimeters and about 2.0 millimeters, an end region, and having an axial and a radial direction; a drive gear having an internal diameter sleeve for fitting over an end of the core cylinder and a key for forcing rotation of the core cylinder; a keyway in the end region of the core cylinder for receiving the drive gear key; and a means for providing strength to the core cylinder wall proximate to the keyway sufficient to prevent cracking from repeated cyclic compression.

Yet another embodiment of the present invention is a process for fusing toner to a copy sheet, comprising: for a period less than about one (1) minute, pre-heating a thin-walled fuser roll comprising core cylinder walls between about 0.5 millimeters and about 2.0 millimeters thick wherein a strengthening means supplements the strength of the thin walls proximate to a keyway formed in the core cylinder; moving a copy sheet into engagement with a nip formed by the fuser roll and a pressure roll; and driving rotation of the fuser roll with a drive gear having an internal diameter sleeve fitting over an end of the core cylinder and a key for engaging the keyway of the core cylinder, thereby moving the paper through the nip.

DETAILED DESCRIPTION

Figure 1:
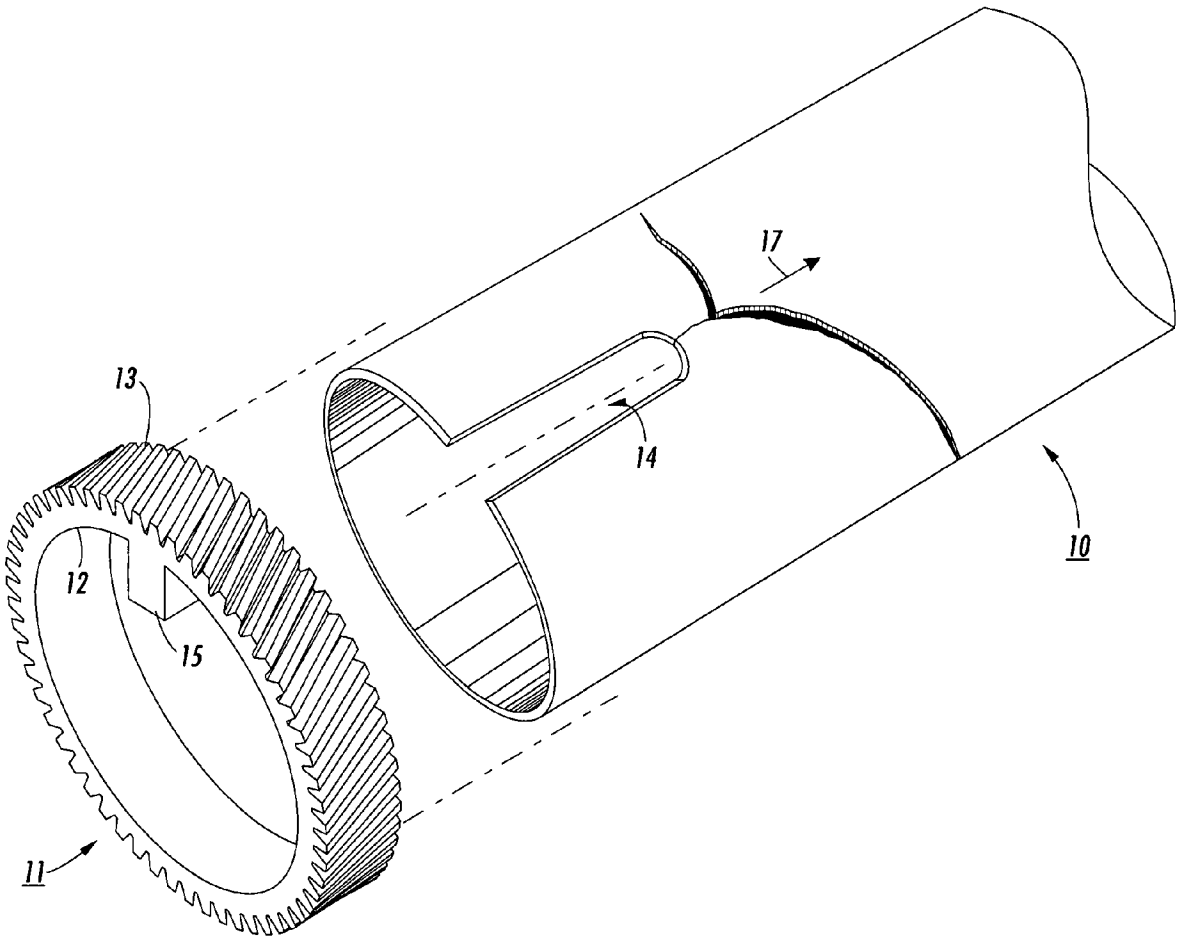
FIG. 1 is a perspective view of thin-walled fuser roll core cylinder assembly showing the failure mode of such an assembly without the strengthening of the present invention.

For a general understanding of the present invention, reference is made to the drawings. In the drawings, like reference numerals have been used throughout to designate identical elements.

An exemplary electronic system comprising one embodiment of the present invention is a multifunctional printer with print, copy, scan, and fax services. Such multifunctional printers are well known in the art and may comprise print engines based upon ink jet, electrophotography, and other imaging devices. The general principles of electrophotographic imaging are well known to many skilled in the art. Generally, the process of electrophotographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. Permanent fixation generally is accomplished by fusing the developing material, or toner, to the support substrate using heat and pressure. Fuser rolls of the present invention are used in this process. In a final step in the process, the photoconductive surface layer of the photoreceptive member is cleaned to remove any residual developing material therefrom, in preparation for successive imaging cycles.

The above described electrophotographic reproduction process is well known and is useful for both digital copying and printing as well as for light lens copying from an original. In many of these applications, the process described above operates to form a latent image on an imaging member by discharge of the charge in locations in which photons from a lens, laser, or LED strike the photoreceptor. Such printing processes typically develop toner on the discharged area, known as DAD, or "write black" systems. Light lens generated image systems typically develop toner on the charged areas, known as CAD, or "write white" systems. Embodiments of the present invention apply to both DAD and CAD systems. Since electrophotographic imaging technology is so well known, further description is not necessary. See, for reference, e.g., U.S. Pat. No. 6,069,624 issued to Dash, et al. and U.S. Pat. No. 5,687,297 issued to Coonan et al., both of which are hereby incorporated herein by reference.

Referring again to FIG. 1, rotation of the fuser roll is caused by engagement of teeth 13 of drive gear 11 with drive mechanisms (not shown) that force gear 11 to turn. Sleeve 12 comprises the internal diameter of gear 11 with the result that sleeve 12 is also driven upon engagement of teeth 13. As described above, key 15 engages slot 14 in order that cylinder 10 is driven by drive gear 11. As the fuser roll turns, print substrates are caught in the nip between the fuser roll and the adjoining pressure roll and are pulled and guided over and past the fuser roll. Since the fuser roll is heated to fusing temperature, the result is fusing the toner to the copy substrate by at least partially melting the toner under pressure.

The failure mode of a thin-walled fuser core cylinder with a conventional drive slot is shown in FIG. 1. In this view, cylinder core 10 has a wall thickness substantially less than the standard 5.5 mm thickness. Wall thicknesses from about 0.5 mm to about 2.0 mm result in substantially shorter warm-up times and substantial improvements in energy efficiency. The thinner the wall, the shorter the warm-up and the greater the energy efficiency. Pre-heating warm-up times less than about 1 one minute is desirable and less than about 30 seconds is preferred. Testing indicated that a wall thickness of about 1.1 mm was adequate for fuser rolls having an outside diameter of about 35.0 mm. Such fuser rolls are typically used in electrostatographic imaging systems capable of printing more than 50 pages per minute. However, as shown in FIG. 1, cracks, such as crack 11, developed from the base of keyway slot 14 in as few as 30,000 copies. Expected life for such fuser rolls is intended to last at least 400,000 copies.

Figure 2:
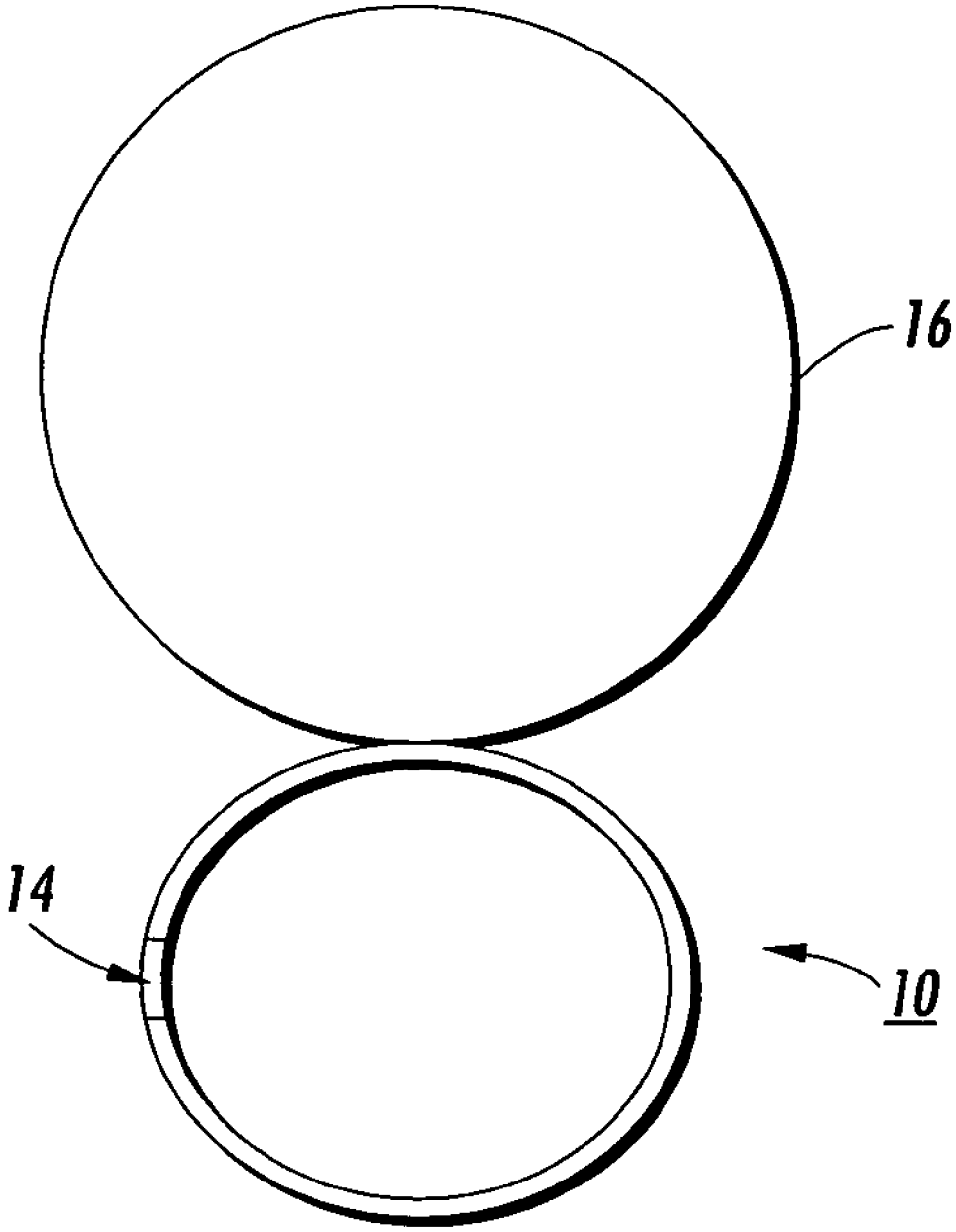
FIG. 2 is a cross-sectional end view of a thin walled fuser roll core cylinder pressed by a pressure roll.

Initial inspection suggested that the cracks developed due to the torque forces imparted by the key upon the thin-walled cylinder. Subsequent investigation revealed, however, that the cracks developed through cyclic compressive force on the roll and especially at the slot location as the roll rotates 90° from the slot into and out of the pressure roll nip. As the cylinder rotates, each portion of its side walls undergoes repeated compression and tension cycles. Most of the length of cylinder 10 is sufficiently removed from slot 12 to resist significant cyclic compression during rotation. As shown in FIG. 2, however, the walls do not have sufficient strength in the end region to resist being partially pushed into the width of the slot by pressure roll 16 because through slot 14 removes all support from this end region. The result is that pressure from pressure 16 roll flattens the end regions proximate to slot 14 during periods in which the slot rotates approximately 90° from the nip of the pressure roll. In conventional core cylinders, the thickness of the walls of the core cylinder provides sufficient strength to prevent cyclic compression.

Further analysis revealed that the compression stresses in the region of slot 14 were directed axially along the length of cylinder 10. Such axially-directed stress is shown by arrow 17 in FIG. 1. With this knowledge, efforts commenced to design a fuser roll core cylinder assembly having thin walls supplemented with strengthening means.

Figure 3:
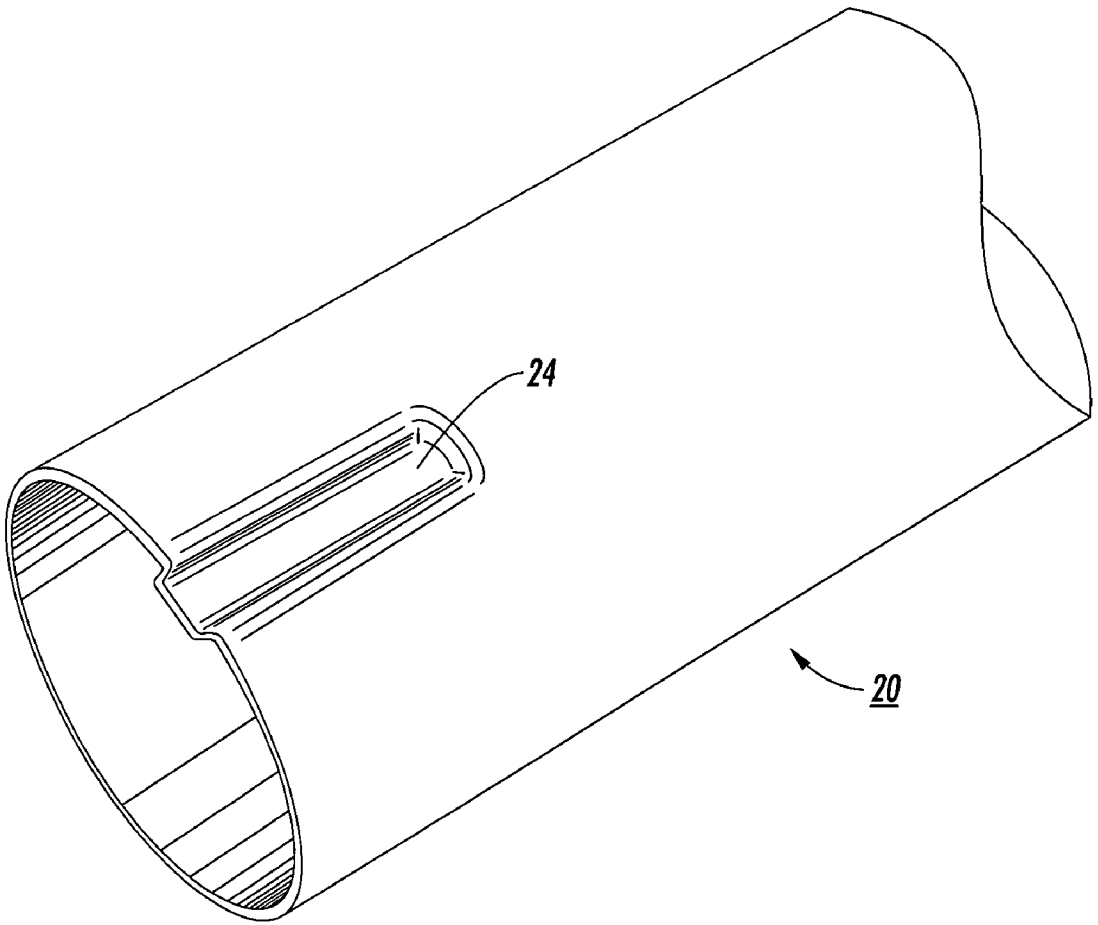
FIG. 3 is a perspective view of a fuser roll core cylinder having a pressed key way for added strength.

One solution to strengthening the walls of a core cylinder is shown in FIG. 3. In FIG. 3, cylinder 20 is shown with a slotless keyway 24 pressed into the wall of cylinder 20. Keyway 24 is sized to accept key 15 shown in FIG. 1. Core cylinder 20 may accordingly be driven by drive gear 11 in the same manner as cylinder 10 shown in FIG. 1. In a manner similar to cylinder 10, cylinder 20 has a wall thickness of only from about 0.5 mm to about 2.0 mm and preferably about 1.1 mm thick. The advantages of fast warm-up time and energy efficiency are accordingly essentially the same as with cylinder 10, i.e., about 1 minute or less and perferably about 30 seconds or less. However, because keyway 24 replaces slot 14, metal remains in the area previously voided by slot 14. The metal, although deformed by the pressing, provides enough strength to prevent the cyclical compression shown in FIG. 2 and, therefore, to prevent the cracking shown in FIG. 1.

Figure 4:
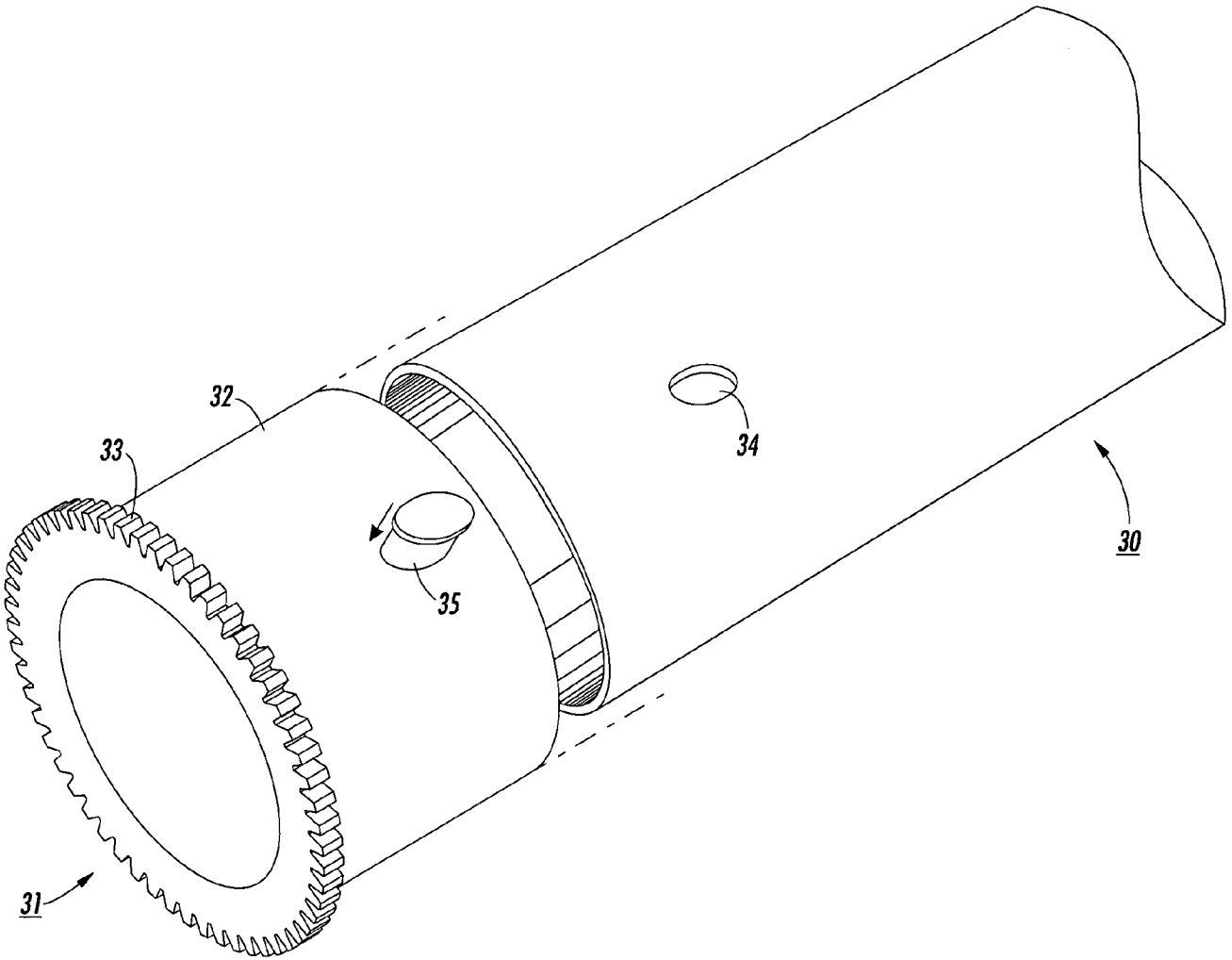
FIG. 4 is a perspective view of a fuser roll core cylinder assembly having a keyhole and a pushable pin on the drive gear.

Another embodiment of the present invention is shown in FIG. 4. In this embodiment, keyway slot 14 from FIG. 1 is replaced by through hole 34. Sleeve 12 is extended outward from gear 11, and key 35 comprises a movable pin. Preferably pin 35 has a flanged top in order to prevent pin 35 from slipping through the hole in sleeve 32 and into the center of cylinder 30. Once sleeve 32 is fit over core cylinder 30 and pin 35 is aligned with keyhole 34, then pin 35 is pressed into keyhole 34. The result is that key 35 is able to drive cylinder 30 and that the end region of cylinder 30 remains comparatively resistant to cyclical compression since the end region comprises a full cylinder but for relatively small hole 34.

Figure 5:
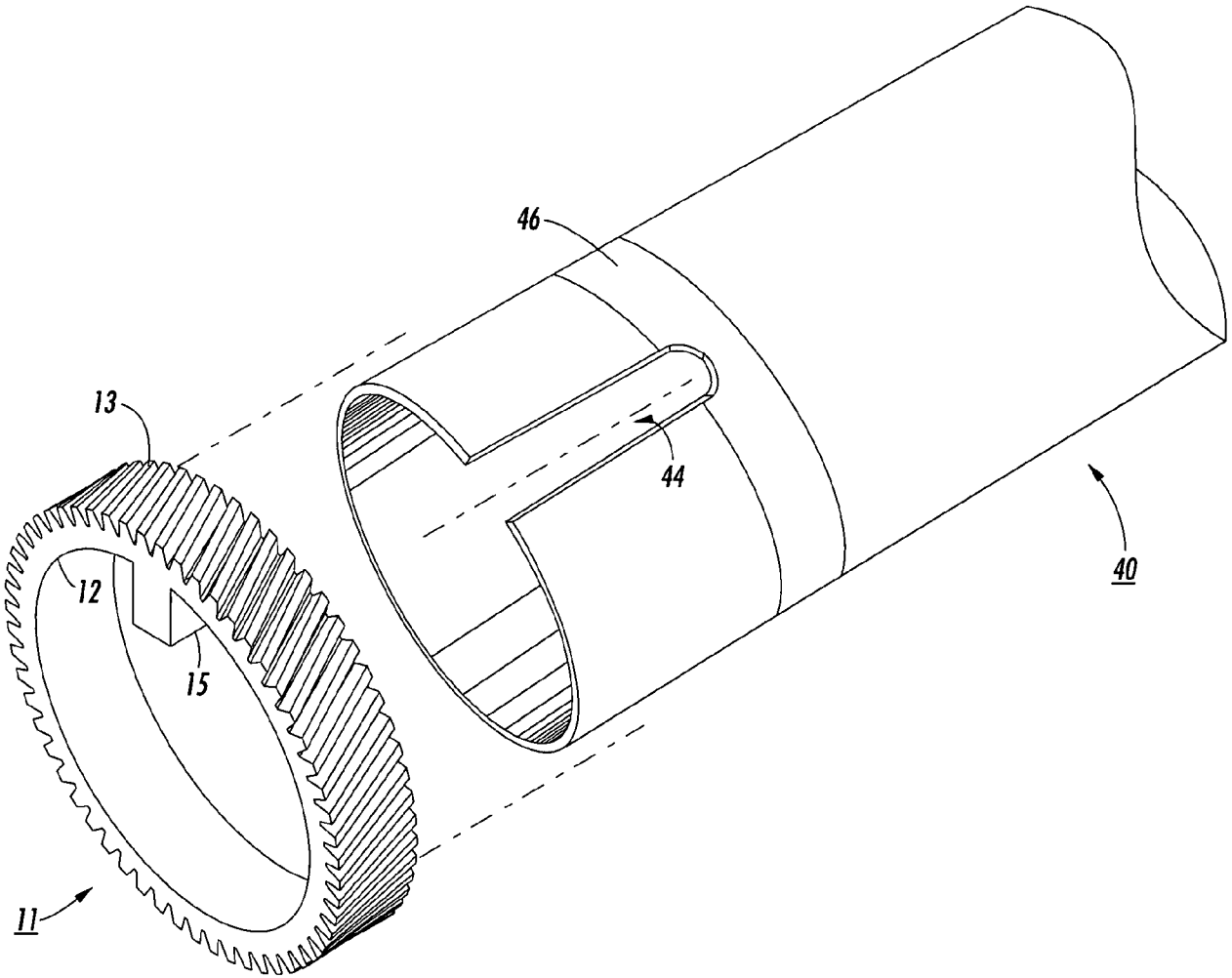
FIG. 5 is a perspective view of a fuser roll core assembly having a reinforcement member to strengthen the thin cylinder walls.

Yet another embodiment is shown in FIG. 5. In this embodiment, a reinforcement member such as ring 46 is mounted proximately to the inside or outside of core cylinder 40 proximate to the terminus of keyway slot 44. In the embodiment shown, ring 46 was affixed to cylinder 40 prior to machining of slot 44, and slot 44 has been machined into a portion of ring 46. Another variation is a ring located on the outside of cylinder 40 such that when cylinder 40 is heated to fusing temperatures, cyclinder 40 expands and is compressed by the ring proximate to the keyway terminus. Although compressed, cyclic compression is avoided since the cylinder at the terminus remains under constant compression. The result of the variations exemplified in FIG. 5 is a strengthening of the walls of cylinder 40 in the region proximate to the end of slot 44 in order that damaging cyclic compression is avoided. For those cylinders made by wrapping a flat sheet around a mandrel and then welding or otherwise sealing the sheet edges to form a cylinder, a reinforcement member such ring 46 can be affixed while the sheet lies flat. As the sheet is bent into a cylinder, then the reinforcement member is also bent. One skilled in the art will understand that a reinforcement member need not be a complete ring. Reinforcement may be adequate if segments are only placed proximate to slot 44 or proximate to slot 44 and opposite such slot. Cyclic compression is not believed as great a problem during the portions of the cylinder's revolution when the slot is proximate to the pressure roll or opposite the pressure roll.

In review, the thin-walled core fuser cylinder assembly of the present invention includes thin walls plus means for strengthening these thin walls in the end region adjacent to the drive gear and its sleeve. When compared to fuser core cylinders in the prior art, the present invention permits faster warm-up times and improved energy efficiency while providing sufficient strength in the end region to prevent cracking caused by cyclic stress.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A thin-walled fuser roll assembly, comprising:

a metallic core cylinder having a wall thickness between about 0.5 millimeters and about 2.0 millimeters, an end region, and having an axial and a radial direction;

a drive gear having an inside diameter sleeve for fitting over an end of the core cylinder and a key for forcing rotation of the core cylinder;

a keyway in the end region of the core cylinder for receiving the drive gear key; and a means for providing strength to the core cylinder wall proximate to the keyway sufficient to prevent cracking from cyclic compression.

2. The thin-walled fuser roll assembly of claim 1, wherein the cylinder is about 35 millimeters in diameter.

3. The thin-walled fuser roll assembly of claim 1, wherein the wall thickness is between about 0.9 and 1.4 millimeters.

4. The thin-walled fuser roll assembly of claim 1, wherein the wall thickness is about 1.1 millimeters.

5. The thin-walled fuser roll assembly of claim 1, wherein the strength means comprises a keyway groove and wherein the key is a pin fixedly protruding from the interior side of the sleeve.

6. The thin-walled fuser roll assembly of claim 5, wherein the keyway groove is a pressed groove.

7. The thin-walled fuser roll assembly of claim 1, wherein the keyway has a terminus and the strength means comprises a reinforcement member mounted proximate to the terminus of the keyway.

8. The thin-walled fuser roll assembly of claim 7, wherein the keyway is an axial slot and the key is a pin fixedly protruding from the interior side of the sleeve.

9. The thin-walled fuser roll assembly of claim 8, wherein the axial slot extends into a portion of the reinforcement member.

10. The thin-walled fuser roll assembly of claim 7, wherein the reinforcement member is mounted inside the core cylinder.

11. The thin-walled fuser roll assembly of claim 7, wherein the reinforcement member is mounted proximately to the outside of the core cylinder.

12. The thin-walled fuser roll assembly of claim 7, wherein the reinforcement member is a ring.

13. The thin-walled fuser roll assembly of claim 7, wherein the reinforcement member is an exterior ring that provides compressive force when the core cyclinder is heated to fusing temperatures.

14. The thin-walled fuser roll assembly of claim 7, wherein the reinforcement member comprises a segment of a ring.

15. The thin-walled fuser roll assembly of claim 14, wherein the keyway slot has an end opposite from the end of the core cylinder and wherein the segment is affixed proximate to the keyway slot end.

16. The thin-walled fuser roll assembly of claim 14, wherein the segment comprises a plurality of segments arranged oppositely to each other.

17. The thin-walled fuser roll assembly of claim 1, wherein the strength means comprises walls around a key hole and wherein the key comprises a pushable pin capable of being pushed into the key hole once the pin and the key hole are aligned.

18. The thin-walled fuser roll assembly of claim 17, wherein the pushable pin has a flange proximate its top end in order to prevent the pin from being pushed beyond the sleeve.

19. An electrostatographic imaging system, comprising:

a thin-walled fuser roll assembly, comprising:

a metallic core cylinder having a wall thickness between about 0.5 millimeters and about 2.0 millimeters, an end region, and having an axial and a radial direction;

a drive gear having an inside diameter sleeve for fitting over an end of the core cylinder and a key for forcing rotation of the core cylinder;

a keyway in the end region of the core cylinder for receiving the drive gear key; and a means for providing strength to the core cylinder wall proximate to the keyway sufficient to prevent cracking from repeated cyclic compression.

20. The electrostatographic imaging system of claim 19, wherein the imaging system is an electrophotographic printer.

21. The electrostatographic imaging system of claim 19, wherein the imaging system is capable of printing more than about 50 pages per minute.

22. A process for fusing toner to a copy sheet, comprising:

for a period less than about one (1) minute, pre-heating a thin-walled fuser roll comprising core cylinder walls between about 0.5 millimeters and about 2.0 millimeters thick wherein a strengthening means supplements the strength of the thin walls proximate to a keyway formed in the core cylinder;

moving a copy sheet into engagement with a nip formed by the fuser roll and a pressure roll; and driving rotation of the fuser roll with a drive gear having an inside diameter sleeve fitting over an end of the core cylinder and a key for engaging the keyway of the core cylinder, thereby moving the paper through the nip.

23. The process of claim 22, wherein the pre-heating is less than about 30 seconds.

24. The process of claim 22, wherein the strengthening means comprises a keyway groove and wherein the key is a pin fixedly protruding from the interior side of the sleeve.

25. The process of claim 22, wherein the strengthening means comprises a reinforcement member mounted proximate to the terminus of the keyway.

26. The process of claim 22, wherein the strengthening means comprises walls around a key hole and wherein the key comprises a pushable pin capable of being pushed into the key hole once the pin and the key hole are aligned.

* * * * *